United States Patent [19]

Patil et al.

[11] 4,125,451

[45] * Nov. 14, 1978

[54] DIAPHRAGMS FROM DISCRETE THERMOPLASTIC FIBERS REQUIRING NO BONDING OR CEMENTING

[75] Inventors: Arvind S. Patil, Grosse Ile; Eugene Yehuda Weissman, Birmingham, both of Mich.

[73] Assignee: BASF Wyandotte Corporation, Wyandotte, Mich.

[ * ] Notice: The portion of the term of this patent subsequent to Jul. 19, 1994, has been disclaimed.

[21] Appl. No.: 791,497

[22] Filed: Apr. 27, 1977

Related U.S. Application Data

[63] Continuation-in-part of Ser. No. 566,911, Apr. 10, 1975, Pat. No. 4,036,729.

[51] Int. Cl.[2] ..... C25B 13/04; C25B 13/08

[52] U.S. Cl. ..... 204/296; 204/252

[58] Field of Search ..... 204/296, 252, 253, 257

[56] References Cited

U.S. PATENT DOCUMENTS

| | | | |
|---|---|---|---|
| 1,865,152 | 6/1932 | Stuart | 204/283 |
| 3,407,249 | 10/1968 | Landi | 264/49 |
| 4,036,729 | 7/1977 | Patil et al. | 204/296 |

FOREIGN PATENT DOCUMENTS

| | | | |
|---|---|---|---|
| 795,724 | 8/1973 | Belgium | 204/296 |

*Primary Examiner*—F.C. Edmundson
*Attorney, Agent, or Firm*—John W. Linkhauer; Bernhard R. Swick; Robert E. Dunn

[57] ABSTRACT

Diaphragms for electrolytic cells are prepared by depositing onto a cathode screen, discrete thermoplastic fibers. The fibers are highly branched, and when deposited, form an entanglement or network thereof, which does not require bonding or cementing.

7 Claims, No Drawings

DIAPHRAGMS FROM DISCRETE THERMOPLASTIC FIBERS REQUIRING NO BONDING OR CEMENTING

CROSS-REFERENCE TO RELATED APPLICATION

This application is a continuation-in-part of our earlier-filed copending application, Ser. No. 566,911, filed Apr. 10, 1975; now U.S. Pat. No. 4,036,729.

BACKGROUND OF THE INVENTION

1. Field of the Invention

The present invention relates to diaphragms for electrolytic cells. More particularly, the present invention relates to diaphragms for electrolytic chlor-alkali cells. Even more particularly, the present invention relates to diaphragms from thermoplastic fibers for use in electrolytic chlor-alkali cells.

2. Description of the Prior Art

Asbestos fibers have long been employed as the conventional material for use as diaphragms in chlor-alkali electrolytic cells. Because of the continuous dissolution of asbestos in the cell liquor, asbestos diaphragms have a limited useful life. Furthermore, as is known to those skilled in the art, asbestos diaphragms evidence swelling, thereby necessitating a choice of the distance between the diaphragm and the cathode to accommodate this swelling phenomenon. Moreover, asbestos has a high electrical resistance, thus reducing cell efficiency. Therefore, the prior art has sought suitable replacements for asbestos as the fibrous material for diaphragms.

In seeking suitable replacements for asbestos in electrolytic cells, the prior art has directed its attention to thermoplastic fibers. Thermoplastic fibers maintain diaphragm continuity in the presence of gaseous turbulence within the cell. Generally, the thermoplastic fibers taught as replacements for asbestos have been fluorinated hydrocarbons, such as polytetrafluoroethylene. See, inter alia, U.S. Pat. Nos. 3,312,614 and 3,702,267. Other thermoplastic compounds taught heretofore include the polyalkylene resins, such as polyethylene and polypropylene. See, inter alia, U.S. Pat. No. 3,775,272.

However, in using such materials, the fibers generally are produced by either a melt-spinning or a melt-blowing process, such as described in U.S. Pat. No. 3,755,527. Although these fibers are eminently useful as replacements for asbestos, it is necessary to either cement the fibers to each other or self-bond the fibers, prior to installation in an electrolytic cell. This is an additional preparatory step which increases the cost of manufacture of such diaphragms.

Other prior art teaches the use of waterleaf rubber diaphragms. However, such materials cannot be used in chlor-alkali cells.

Thus, a major advancement in the art would be provided if thermoplastic fibers, requiring no cementing or bonding, could be employed as diaphragms for electrolytic cells, and especially, in chlor-alkali cells.

SUMMARY OF THE INVENTION

In accordance with the present invention, discrete thermoplastic fibers are produced by a process which provides highly branched fibers. The so-produced highly branched fibers are deposited on a cathode screen or the like and, are, then, used as diaphragms.

The highly branched fibers, when deposited, provide an entanglement or network of fibers which do not require cementing or bonding prior to deployment.

The highly branched fibers can be produced in accordance with the process described in Belgian Patent No. 795,724, or any other process which produces highly branched fibers. In a preferred method, fibers are produced by a process in which the polymer is dissolved in a suitable solvent such as tetrahydrofuran and then the polymer solution is led through a nozzle under conditions of high energy into an aqueous media in which the solvent is soluble but the polymer is not.

The preferred thermoplastic materials employed herein are the fluorohydrocarbon fibers. The present invention also provides an improved mode of dispersing fluorohydrocarbon fibers, preparatory to depositing the fibers on the cathode screen.

For a more complete understanding of the present invention, reference is made to the following detailed description and accompanying example.

DESCRIPTION OF THE PREFERRED EMBODIMENTS

As hereinbefore noted, the present invention contemplates the formation of a diaphragm, for use in an electrolytic cell, and in particular, a chlor-alkali cell, from highly branched thermoplastic fibers.

By utilizing highly branched thermoplastic fibers, it has been found that the necessity for cementing or bonding the fibers to each other is eliminated. The branched fibers form an entanglement or network of intermeshed fibers which are inter-entangled to a degree such that the same effect as accompanies cementing or bonding is realized.

In practicing the present invention, any branched thermoplastic fiber capable of withstanding the internal conditions of a chlor-alkali cell can be utilized. Such thermoplastic fibers, in order to be efficacious, must exhibit resistance to chemical degradation, low electrical resistance, and adequate hydraulic permeability. Thus, suitable thermoplastic fibers contemplated herein include polyolefins, polycarbonates, polyesters, polyamides, and the like, as well as mixtures thereof. Representative of these types of compounds are, for example, polyethylene, polypropylene, hexamethylene adipamide and other nylons, polyethylene terephthalate, poly-4-methylpentene-1, poly(tetramethylene) terephthalate, polystyrene-polyvinylidene copolymers, polycarbonates of 2-(4-hydroxymethyl) propane (bisphenol A), polyphenylene oxide and the like, as well as mixtures thereof. Also, polyarylsulfones can be utilized herein.

A particularly preferred class of thermoplastic fibers contemplated for use herein is the fluorinated hydrocarbons, and in particular, fluorinated polyalkylenes. The fluorinated polyalkylenes can be additionally halogen-substituted fluorinated polyalkylenes. Representative of the fluorinated hydrocarbons are, for example, polytetrafluoroethylene, fluorinated ethylene-propylene copolymers, polychlorotrifluoroethylene, polyvinylidenefluoride, polyethylenechlorotrifluoroethylene, polyethylenetetrafluoroethylene and tetrafluoroethyleneperfluorovinylether sulfonyl fluoride copolymers. Additionally, blends of fluorohydrocarbons with any of the hereinbefore enumerated thermoplastic fibers can be utilized herein.

It is also possible to use other highly branched, nonpolymeric fibers, in admixture with the polymeric fibers hereof. Thus, minor amounts of asbestos fibers and the like can be used in admixture with the highly branched fibers hereof.

As noted hereinbefore, conventional melt spinning and blowing processes do not produce the branched fibers hereof. Rather, in order to produce the branched fibers hereof, a process such as that indicated above or that described in Belgian Pat. No. 795,724, the disclosure of which is hereby incorporated by reference, is employed.

Generally speaking, the process disclosed in the Belgian patent comprises extruding a polymer melt from a spinneret in the presence of an auxiliary liquid medium. The auxiliary liquid medium applied a shear force to the formed fibers or fibrids as the melt is discharged from the spinneret orifices. The melt is, thus, caused to fragment in a zone of high energy loss. This results in the formation of fibers having pre-determined exact dimensions in a single step. According to the reference, the fibrids thereof have a length of about 100 times the diameter.

It is to be understood that other melt solution or solution-spinning processes which form highly branched fibers can be equally utilized herein. The only criticality attached hereto is that highly branched fibers be utilized.

By the process thereof, and as disclosed therein fibrids can be produced which have a structure resembling natural fibers, including ends which interlink the different elements, i.e., branched fibers.

The fibers utilized in accordance herewith, as noted, are highly branched and have a fiber diameter of from about 0.1 to about 40 microns, and are, preferably, less than 1 micron. The efficacy of the use of fibers in diaphragms having such minute diameters is disclosed in copending U.S. patent application Ser. No. 548,684, entitled "Thermoplastic Fibers as Separator or Diaphragm in Electrochemical Cells", and filed on Feb. 10, 1975.

As is known to those skilled in the art, fluorinated hydrocarbon fibers, per se, are difficult to disperse in an aqueous medium, thereby rendering such fibers difficult to deposit on a cathode screen or support. To alleviate this situation, the present invention also includes an improved method of dispersing fluorinated hydrocarbon fibers.

It has now been found that if the fibers are dispersed in an aqueous-acetone medium, and in the presence of a surfactant, to form a slurry, the problems of dispersing the fibers are overcome.

The aqueous-acetone medium is generally prepared by mixing the water and acetone together in a volumetric ratio of from about 0.5:1 to about 1:0.5. Preferably, a 1:1 volumetric ratio of water to acetone is employed.

Use of an acetone-water mixture is not always necessary, however. Water alone can be used.

The surfactant is employed in an amount ranging from about 0.01% to about 10% by weight, based on the weight of the slurry.

Useful surfactants include both organic and inorganic wetting agents. suitable organic wetting agents or surfactants are the nonionic and anionic surfactants.

Useful nonionic surfactants include the oxyalkylene condensates of ethylene diamine, such as the block copolymers of ethylene oxide and propylene oxide prepared by the sequential addition thereof to ethylene diamine, as described in U.S. Pat. No. 2,979,528. Other useful organic surfactants include polyoxyethylene alkylphenols, polyoxyethylene alcohols, polyoxyethylene esters of fatty acids, polyoxyethylene mercaptans, polyoxyethylene alkylamines, polyoxyethylene alkylamides, the polyol surfactants, and the like.

Suitable inorganic wetting agents which can be internally incorporated into the fibers include, for example, asbestos; mica; titanates, such as barium titanate, and potassium titanate; talc; vermiculite; titanium dioxide; boron nitrides; kaolinite; diatomaceous earth and clays; as well as mixtures thereof.

In the practice of the present invention, the preferred surfactants are the perfluorinated fatty acids, alcohols or sulfonate-based surfactants. These surfactants are widely known and commercially available. They are sold under a plurality of trademarks, such as FLUORAD FC-126 or FC-170; and Zonyl FSM, FSA or FSP.

The branched fibers hereof are dispersed in the surfactant-containing water or water-acetone medium in an amount ranging from about 1 to 15 percent, by weight, based on the total weight, to form a slurry.

The slurry is then vacuum-deposited on a cathode screen by any suitable method. A particularly preferred method of depositing the slurry contemplates the immersion of the cathode screen, mounted in a vacuum box, into the slurry which is maintained in a state of agitation. Then, a series of increasing partial vacuums are applied across the screen for a period of time, followed by a full vacuum for a pre-determined period of time. The screen having the fibers deposited thereon is then dried, at a temperature of about 100° C. for about 1 to 3 hours, to evaporate the water.

The so-formed diaphragm comprises, as noted, an entanglement of fibers which does not require self-bonding or cementing.

It should be noted that with respect to the present invention, the use of the type of process described in the above-referred to Belgian patent is critical hereto, i.e., a process in which the polymer passes through an orifice under high-energy conditions into an aqueous medium or other suitable auxiliary liquid. Although the use of this process for forming thermoplastic fibers has heretofore been described in the above-referred-to copending U.S. patent application, it was not known until now that the highly branched fibers produced thereby could be employed directly as a diaphragm without the need for bonding or cementing the fibers.

Following is a specific, non-limiting example illustrating the principles of the present invention.

EXAMPLE

Into a 1:1 water-acetone medium containing 0.1%, by weight of a fluorocarbon surfactant sold commercially under the name FLUORAD FC-126 was added 6 percent, by weight, of polyvinylidenefluoride fibers. The fibers were produced by the process described in Belgian Pat. No. 795,724. The fibers were mixed and dispersed in the medium to form a slurry thereof.

While maintaining the slurry in a state of agitation, a cathode screen, mounted in a vacuum box, was submerged in the slurry. A partial vacuum of 1" of Hg was applied to the box for 3 minutes. Then, the vacuum was increased to 3" of Hg and was applied to the box for 3 minutes. While still maintaining the slurry in a state of agitation, a full vacuum was then applied to the box for 5 minutes.

The so-deposited diaphragm on the cathode screen was then dried in an oven for 2 hours at 100° C.

The diaphragm was then mounted in a test chloralkali cell and subjected to brine electrolysis. The cell with the diaphragm mounted therein produced 98 grams per liter of caustic at 81% current efficiency. This establishes the efficacy of the present invention.

The embodiments of the invention in which an exclusive property or privilege is claimed are defined as follows:

1. In an electrolytic cell having a diaphragm deposited on a cathode screen, an improved diaphragm therefor, said diaphragm consisting essentially of an entanglement of highly branched thermoplastic polymeric fibers, the fibers being capable of withstanding the internal conditions of the cell, the fibers being of the type produced by passing a polymer through a nozzle under high-energy conditions in the presence of an auxiliary liquid medium which shears the polymer into highly branched fibers, and wherein fibers are entangled to a degree such that they are free from bonding or cementing agents.

2. The improvement of claim 1 wherein the highly branched thermoplastic fibers are utilized in admixture with a wetting agent.

3. An improved diaphragm according to claim 1 wherein the branched thermoplastic fiber selected from the group consisting of polyolefins, polycarbonates, polyesters, polyamides, fluorinated hydrocarbons, and mixtures thereof.

4. The improved diaphragm of claim 1 wherein the branched thermoplastic fiber is a fluorinated hydrocarbon.

5. The improved diaphragm of claim 1 wherein the branched thermoplastic fiber is polyvinylidene fluoride.

6. The improved diaphragm of claim 1 wherein the fibers have a diameter of from about 0.1 micron to about 40 microns.

7. The improved diaphragm of claim 1, wherein the electrolytic cell is a chlor-alkali cell.

* * * * *